United States Patent [19]

Daniels

[11] 4,415,151

[45] Nov. 15, 1983

[54] COLLAPSIBLE REBOUND EXERCISE DEVICE

[76] Inventor: Kenneth M. Daniels, 125 Roberta Dr., Woodside, Calif. 94062

[21] Appl. No.: 353,689

[22] Filed: Mar. 1, 1982

[51] Int. Cl.[3] ..... A63B 5/18

[52] U.S. Cl. ..... 272/65

[58] Field of Search ..... 272/65, 139, 140; 108/111, 112, 115, 116; 248/166, 167, 460; 403/53, 54; 135/104

[56] References Cited

U.S. PATENT DOCUMENTS

| | | | |
|---|---|---|---|
| 663,856 | 12/1900 | Browder | 182/140 |
| 1,132,061 | 6/1915 | Backer | 248/166 |
| 2,197,478 | 4/1940 | Mathieu | 135/104 |

*Primary Examiner*—Richard C. Pinkham

*Assistant Examiner*—Stephen R. Crow

*Attorney, Agent, or Firm*—Hamrick, Hoffman & Guillot

[57] ABSTRACT

A collapsible rebound exercise apparatus (10) as a resilient, flexible mat (12) capable of forming a substantially planar surface when an associated frame (14) supporting the mat has an open framework (16) thereof disposed in a substantially planar, open position. The framework is provided with two pair of hinges (18, 20) arranged perpendicularly to each other and which permit the framework to first fold symmetrically in overlying relation on itself, and subsequently to collapse on itself by pivotal movement perpendicular to the folding movement. Once folded and collapsed, the framework and associated mat form a generally rectangular package which can be placed in a suitable container, such as a flexible bag (32), for storage and transport.

10 Claims, 15 Drawing Figures

COLLAPSIBLE REBOUND EXERCISE DEVICE

BACKGROUND OF THE INVENTION

1. Field of the Invention

This invention relates generally to exercise devices, and more particularly, to a rebound exercise device which can be collapsed into a small package for easy storage and handling.

2. Description of the Prior Art

The current emphasis on physical fitness has resulted in a proliferation of various devices useful in performing various exercises. Among these devices are apparatuses based on the trampoline, but smaller and more portable. Such rebound devices are particularly popular for simply jogging-in-place.

One such rebound exercise device that has proven popular has a circular framework about one meter in diameter and resiliently supporting as by a plurality of coiled springs a flexible mat which also is circular in plan. A plurality of legs, for example six, support the framework above a floor or other suitable support surface, while an annular cover arranged on the framework covers the mat supporting springs adjacent an upper surface of the mat for safety and aesthetic reasons.

One drawback to apparatuses as discussed above is that its size, while much smaller than a standard trampoline, creates storage and portability difficulties. Accordingly, it has been proposed to permit the apparatus to be folded into a smaller package simply by placing four identical hinges, two rotated 90° relative to the others, equally spaced on the circular framework to permit folding of the framework into a smaller size. Problems have been encountered, however, with such an arrangement, inasmuch as the hinges tend to buckle during use of the device, and generally eliminate the necessary rigidity to the framework which is necessary for proper operation of the apparatus.

SUMMARY OF THE PRESENT INVENTION

It is an object of the present invention to provide a collapsible rebound exercise apparatus which can be locked rigidly in place during use, but can be conveniently collapsed for storage and transport.

It is another object of the present invention to provide a collapsible framework which can be locked rigidly in a use position in a simple yet rugged and reliable manner.

Still another object of the present invention is to provide a collapsible rebound exercise apparatus which can employ a support system for the apparatus to rigidly lock same in a use position.

These and other objects are achieved according to the present invention by providing a collapsible rebound exercise apparatus having a mat arranged for creating a resilient, flexible, substantially planar surface resiliently supported on a frame which includes an open framework surrounding the mat arrangement. The framework includes a first pair of opposed hinges disposed for permitting the framework to be moved between a substantially planar open position and a folded or collapsed position, and including a lock arrangement for retaining the framework in the open, or use, position.

A further pair of opposed hinges are disposed perpendicularly to the first pair of hinges on said framework for permitting the latter to be collapsed on itself once same is folded by action of the first pair of hinges. A support arrangement is associated with the frame for holding the framework when same is in the open position, and preferably is formed by legs or other supporting braces of the apparatus which can be selectively inserted into and removed from the locks for engaging and disengaging same. Alternatively to the support arrangement being legs, it can be braces which hold the mat arrangement in a substantially vertical or inclined plane to permit use of the apparatus to cushion the impact of spheriods, and the like, thrown or otherwise propelled against the mat of the apparatus.

Accordingly, it is an advantage of the present invention that a rebound exercise apparatus can be conveniently collapsed for storage and/or transportation although remaining rigid when in use.

Another advantage of the present invention is that no extra elements are necessary beyond those employed with the apparatus in its intended uses in order to permit collapsing of the device when not in use for storage and transportation purposes.

These and other objects and advantages of the present invention will no doubt become apparent to those of ordinary skill in the art after having read the following detailed description of the preferred embodiments which are illustrated in the several figures of the drawing.

IN THE DRAWING

DETAILED DESCRIPTION OF THE PREFERRED EMBODIMENTS

Figure 1:
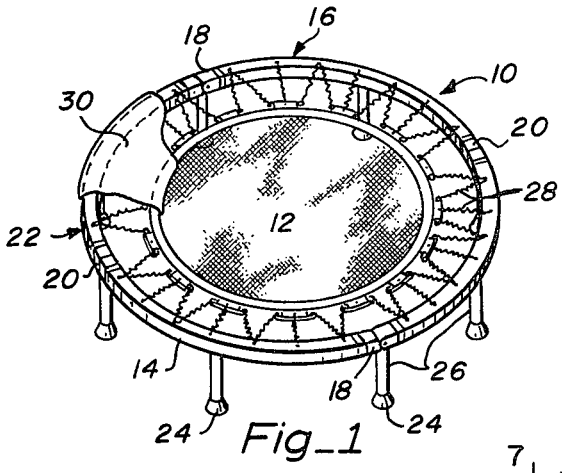
FIG. 1 is a diagrammatic, perspective view, partly broken away and in section, showing a rebound exercise apparatus according to the present invention.

Referring now more particularly to FIG. 1 of the drawings, a collapsible rebound exercise apparatus 10 according to the present invention includes a mat 12 arranged for creating a resilient, flexible, substantially planar surface and is supported by a frame 14 which includes an open framework 16 circular in plan and arranged surrounding and connected to mat 12. A pair of opposed hinges 18 are disposed such that a pivot axis of a hinge 18 is diametrical of the circular framework 16 in order to permit framework 16 to be moved between a substantially planar open position as seen in FIG. 1 and a folded position as to be described below. Framework 16 also includes a further pair of opposed hinges 20 inserted therein in diametrical opposition and arranged for pivoting about spaced, parallel axis substantially perpendicular to the axis passing through hinges 18 and to the plane of framework 16 when same is in the aforementioned open position in order to permit framework 16 once in the folded position resulting in pivoting about hinges 18 to be collapsed on itself to form a generally rectangular package. A lock assembly 22 is associated with hinges 18 and 20 for retaining framework 16 in the open, or use, position illustrated in FIG. 1, while a support arrangement 24 is associated with frame 14 for positioning framework 16 as desired when same is in the aforementioned open position so as to permit appropriate use of apparatus 10.

While support arrangement 24 is to be described herein as comprising a plurality of supporting legs 26, it is to be understood that this arrangement could also include braces (not shown) capable of positioning apparatus 10 such that mat 12 is in a substantially vertical or inclined plane (not shown) in order to permit apparatus 10 to be used as a rebound device for various projectiles (not shown) in a known manner.

Mat 12 is resiliently supported on framework 16 in a conventional manner by a plurality of coiled springs 28. An annular cover 30, only a fragment of which is seen in FIG. 1, is advantageously arranged around framework 16 in a conventional manner so as to cover springs 28 adjacent the upper surface of mat 12 and enhance both the safety and the aesthetics of apparatus 10. With the exception of hinges 18 and 20, to be described below, the construction of apparatus 10 as described above is of a conventional nature identical to such devices currently on the market and, therefore, this construction will not be described in greater detail herein.

Figure 2:
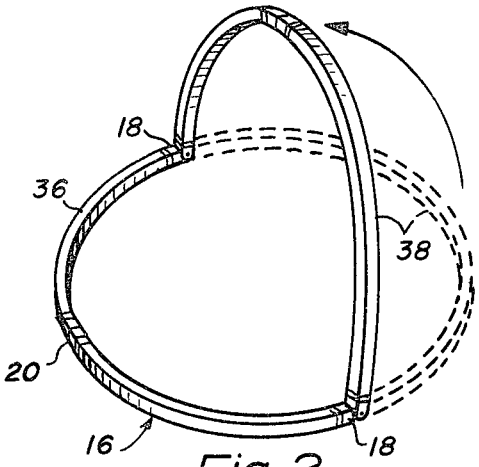
FIG. 2 is a diagrammatic, perspective view, showing only the collapsible framework of the apparatus seen in FIG. 1, with the framework being moved from a planar, or use, position to a folded position.
Figure 3:
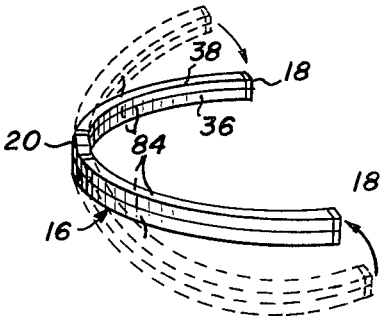
FIG. 3 is a diagrammatic, perspective view, showing the framework of FIG. 2 folded on itself and being collapsed into a storage and transport mode.
Figure 4:
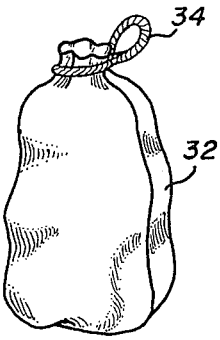
FIG. 4 is a diagrammatic, perspective view, showing a bag in which a collapsed apparatus according to the present invention may be placed for storage and transport.

Referring now more particularly to FIGS. 2–4 of the drawings, it will be seen that framework 16 can be initially folded into a semi-circular arrangement by pivoting hinges 18 about the axis diametrical of framework 16, as seen in FIG. 2. Once so folded, framework 16 can now be collapsed on itself by pivoting movement about the axes of hinges 20, which axes are parallel but not co-axial, in the manner seen in FIG. 3, so as to form a compact package which can be stored and transported in a convenient manner, such as by use of a flexible bag having a conventional drawstring arrangement 34, or other suitable container construction, as seen in FIG. 4. Such a resulting package may be no larger than, for example, three inches by ten inches by twenty inches (7.6 cm×25.4 cm×50.8 cm). While any suitable material may be employed to contruct bag 32, the use of such a material as nylon has been found satisfactory.

The construction of hinges 18 and the associated portions of lock assembly 22 will now be described in conjunction with FIGS. 5–8 of the drawings.

Framework 16 is interrupted at the pair of opposed hinges 18 to form a pair of substantially identical framework portions 36 and 38 which are mirror-images to one another. Hinges 18 hold together these portions 36 and 38, with each hinge 18 comprising a first bracket 40 affixed to a respective one of portions 36, 38 and provided with a threaded hole 42. A second bracket 44 provided with a bore 46 is affixed to the other of framework portions 38, 36 in opposed relation with and pivotally attached to bracket 40. More specifically, brackets 40 and 44 are pivotal relative to one another about a diametrical axis lying in the plane of framework 16 when same is in the aforementioned open position so as to permit the folding of framework 16 into the oval-line position as shown diagrammatically to FIGS. 2 and 3 of the drawings.

Bracket 40 is substantially U-shaped in transverse section, and includes a neck 49 of reduced cross sectional area which is inserted within an associated end of portion 36 to which bracket 40 is affixed as by welding, and the like. Extending from neck 48 is a back 50 in which a threaded hole 42 is defined. A pair of substantially parallel sides 52 terminating in ears 54 having formed therein aligned apertures 56 depend from back 50. Disposed between sides 52 and abutting the inner or lower surface of back 50 is a weld block 58 having provided therein a threaded bore 60 in alignment with threaded hole 42. The purpose of block 58 and bore 60 is to provide an additional length of screw threads for engagement by a threaded stud to be described below when hinge 18 is locked.

Bracket 44 includes a pair of substantially parallel, spaced lobes 62 each provided with an aperture 64 aligned with one another and with apertures 56 for receiving a pivot pin 66 articulating brackets 40 and 44 to one another. Extending from lobes 62 so as to be substantially parallel to back 50 of bracket 40 is a tongue 68 provided with a hole 70 arrangeable in alignment with hole 42 and bore 60 and terminating in a pair of substantially upstanding fingers 72 forming an upright U-shaped section engageable within the generally rectangular configuration of portion 38 of framework 16. These fingers 72 can be affixed to the associated portion 38 as by welding, and the like, in the manner of attachment of neck 48 to portion 36. A weld block 74 provided with a central opening 76 is advantageously secured, again as by welding and the like, to the lower surface of tongue 68 in order to provide an additional bearing surface for a locking member as will become clear below.

Unless otherwise specified, welding is preferred for rigidly attaching various elements of hinges 20 to one another and to framework 16.

Figure 6:
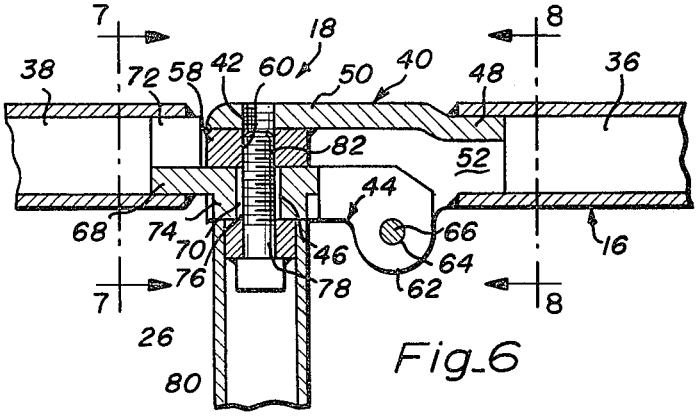
FIG. 6 is a fragmentary, enlarged, sectional view, taken generally along the line 6—6 of FIG. 5.
Figure 7:
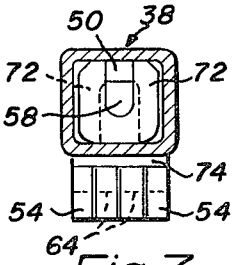
FIG. 7 is a sectional view taken generally along the line 7—7 of FIG. 6, but with the supporting leg removed for clarity.
Figure 8:
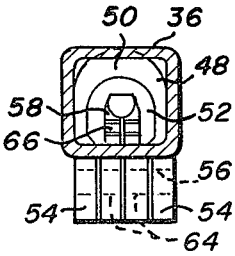
FIG. 8 is a sectional view taken generally along the line 8—8 of FIG. 6, but with the supporting leg removed for clarity.

A bolt system 78 is removably disposed in hole 42 and bore 60, as well as hole 70 and opening 76, for restraining framework 16 from movement when in the planar or open position as seen fragmentarily in FIG. 6. As illustrated, system 78 includes a support member 80 which in the illustrated embodiment forms a leg 26 according to the present invention. Terminating an upper portion of support member 80 is a screw threaded stud 82 engageable in the threaded hole 42 and bore 60 for retaining support member 80 in abutting relationship with the lower surface of weld block 74. As can be seen from FIG. 6, stud 82 extends through hole 70 and opening 76 to reach the screw threaded part of bracket 40. When so arranged, support member 80 prevents brackets 40 and 44 from pivoting relative to one another, while simultaneously supporting framework 16 as desired.

Figure 9:
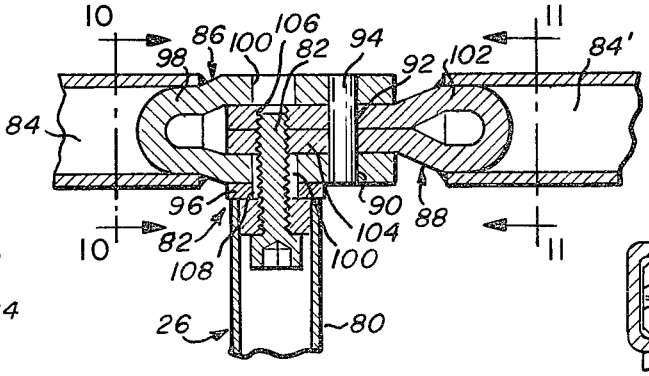
FIG. 9 is a fragmentary, enlarged, sectional view taken generally along the line 9—9 of FIG. 5.
Figure 10:
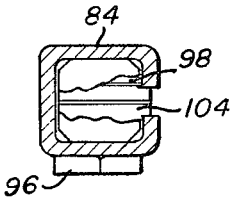
FIG. 10 is a sectional view taken generally along the line 10—10 of FIG. 9, but with the supporting leg removed for clarity.
Figure 11:
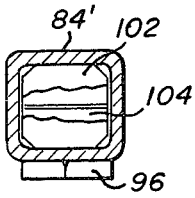
FIG. 11 is a sectional view taken generally along the line 11—11 of FIG. 9, but with the supporting leg removed for clarity.
Figure 5:
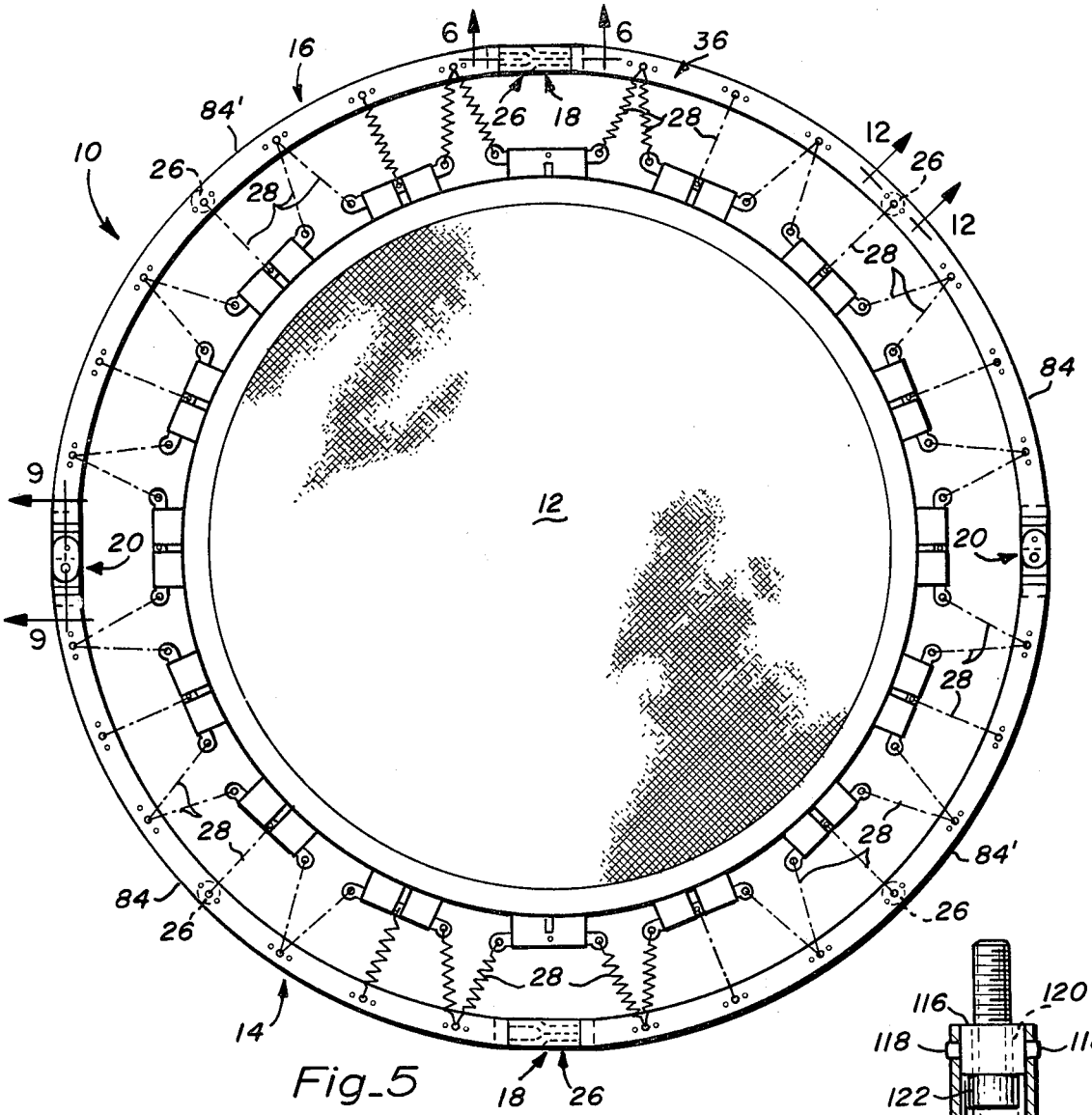
FIG. 5 is a diagrammatic, top plan view showing the apparatus of FIG. 1 to a larger scale.

Referring now more particularly to FIGS. 9–11 of the drawings in conjunction with FIG. 5, it will be seen that hinges 20 also have associated therewith for assisting in retaining framework 16 in the aforementioned open position thereof a lock assembly 82 partially forming assembly 22. It will also be seen that each portion 36, 38 of framework 16 is further interrupted at hinges 20 to form in each of framework portions 36, 38 a pair of segments 84, 84' each a mirror image of the other and articulated together by hinges 20, the construction of which will be described below.

Each hinge 20 comprises a generally U-shaped clip 86 affixed to a respective one of segments 84, 84', and a generally key-shaped element 88 affixed to the other of the segments 84', 84 in suitable manner. Each of the clip 86 and element 88 is provided with a through hole 90 and 92, respectively, in which is arrangeable a pivot shaft 94 articulating clip 86 and element 88 to one another for pivotal movement within the plane of each semicircular portion of framework 16. The lower surface of the lowermost of the legs of clip 86 can have attached thereto a boss 96 provided with a suitable opening to act as a bearing surface in the manner of weld block 74.

U-shaped clip 86 includes a pair of substantially parallel, co-extensive legs 98 each provided with a hole 100 and arranged top and bottom relative to the associated segment 84. Element 88, on the other hand, includes an enlarged head 102 from which extends a shank 104 formed by a pair of adjacent, co-extensive parts received within the legs 98 of clip 86 such that threaded bores 106 provided in shank 104 are in register with holes 100 formed in legs 98. As will be appreciated, opening 108 formed in boss 96 is also in alignment with threaded bores 106 to permit passage of a threaded stud 82 in the identical manner to insertion of stud 82 into opening 76 and bore 46 of hinge 18. Thus, threaded stud 82 can be threaded into bores 106 and support member 80 arranged abutting boss 96 in order to restrain hinge 20 from pivoting movement about shaft 94.

Figure 12:
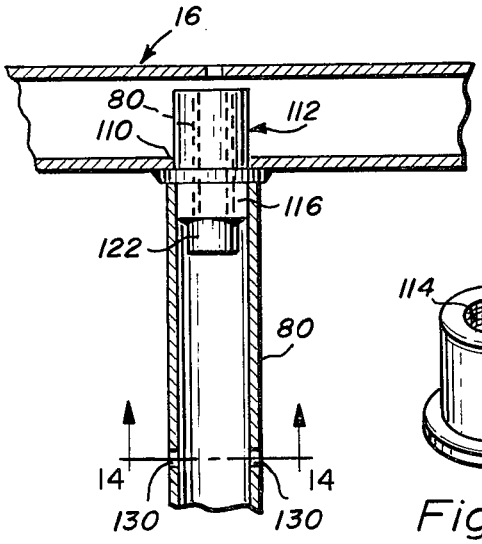
FIG. 12 is a fragmentary, enlarged, sectional view taken generally along the line 12—12 of FIG. 5.
Figure 13:
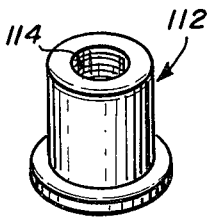
FIG. 13 is a perspective view showing a bushing used in mounting a supporting leg or brace in accordance with FIG. 12.

FIGS. 12 and 13 show an arrangement wherein additional legs, there advantageously being eight legs in all, can be attached to framework 16 at points other than the four hinges 18, 20. This arrangement includes perforations 110 provided in the lower surface of the generally rectangular cross section framework 16 at points substantially equal distance between hinges 18, 20 for receiving a flanged bushing 112 provided with an internally threaded, through bore 114. Attachment of the flange of bushing 112 to framework 16 can be accomplished in a suitable manner. As can be seen from FIG. 12, the threaded stud of support member 80 can be threadingly received into bore 114, with support member 80 itself abutting the lower surface of the flange of bushing 112.

Figure 14:
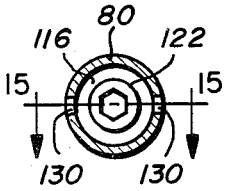
FIG. 14 is a sectional view taken generally along the line 14—14 of FIG. 12, but with the apparatus framework and mounting bushing removed for clarity.
Figure 15:
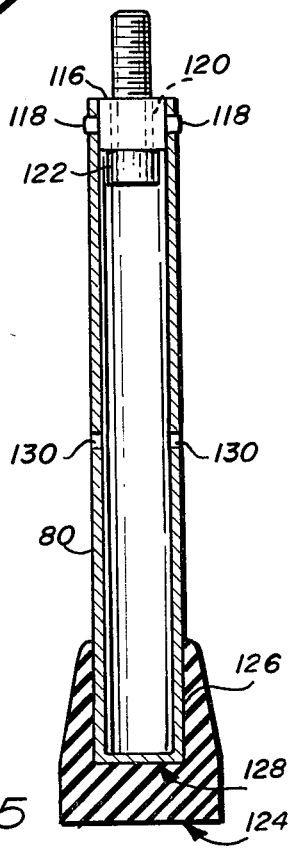
FIG. 15 is a sectional view taken generally along the line 15—15 of FIG. 14.

A leg 26 according to the invention is shown in greater detail in FIGS. 14 and 15, wherein it can be appreciated that retainingly fitted into an upper end of support member 80 is a cylindrical plug 116 affixed in position as by suitable welds made in perforations 118 provided in the sidewalls of support member 80. Disposed centrally of plug 116 is a screw threaded hole 120 which threadingly receives the stud 82, itself forming part of a screw in combination with a suitable cap 122. At the other or lower end of support member 80 is a resilient foot 124 provided with a socket 126 in which is fittingly received support member 80. A circular or disc-like plate 128 is disposed between the lower end of support member 80 and the bottom of socket 126 in order to prevent cutting of cylindrical member 80 into foot 124. A pair of laterally aligned holes 130 advantageously are provided midway in the length of support member 80 for receiving a bar (not shown) and the like, which facilitates threading and unthreading of a leg 26 into an appropriate socket provided in framework 16 or in hinges 18, 20.

As can be readily appreciated from the above description and the drawings, apparatuses according to the present invention permits a readily collapsible framework which is rigid when erected. When it is desired to collapse the apparatus, all that need be done is to unthread the legs or other supporting braces from the framework and hinges in order to unlock the hinges and permit the framework to be folded and collapsed as described above in conjunction with FIGS. 2 and 3. The mat, being constructed from a flexible material, will fold and collapse with the framework, providing a compact package facilitating storage and transport of the apparatus. Attachment of legs at the hinges improves rigidity of the frame by providing good support at the hinges.

Whereas the preferred embodiment of the present invention has been described above, it is contemplated that other alterations and modifications may become apparent to those skilled in the art after having read the above disclosure. It is therefore intended that the appended claims be interpreted as covering all such alterations and modifications as fall within the true spirit and scope of the invention.

What is claimed is:

1. A collapsible rebound exercise apparatus comprising:

mat means for providing a resilient, flexible exercise surface;

frame means for supporting said mat means and including an open framework having first and second portions which are mirror images of each other and which are joined together by first and second hinge means that allow said framework to be folded along an axis of symmetry from an open configuration lying in a plane defined by said framework to a folded configuration wherein said second portion is disposed in overlying relationship with said first portion, each said hinge means including;

a first bracket affixed to one of said first and second portions and provided with a hole, and a second bracket provided with a bore and affixed to the other of said first and second portions in opposed relationship with and pivotally attached to said first bracket, said first bracket and said second bracket being pivotal relative to one another about said axis of symmetry; and support means affixed to said frame means for positioning said frame means above a supporting surface when said frame means is in said open configuration, said support means including bolt means extending therefrom in such a manner as to pass through said holes and into said bores to lock said hinges and restrain said frame means from folding.

2. Apparatus as defined in claim 1 in combination with a container, said framework being selectively insertable into said container when said framework is in the folded position and collapsed on itself.

3. Apparatus as defined in claim 1, wherein said framework is circular in plan, and said axis of symmetry is arranged diametrically of said framework.

4. Apparatus as defined in claim 1, wherein said first bracket is substantially U-shaped in transverse section, and said second bracket extends partially within the U-shaped portion of said first bracket, with said hole and said bore being arranged in register with one another.

5. Apparatus as defined in claim 1, wherein said bolt means includes a pair of studs provided with screw threads, and said bores are tapped for threadably receiving said studs.

6. Apparatus as defined in claim 1, wherein said suport means includes a plurality of legs arrangeable for supporting said framework above a suitable support surface.

7. Apparatus as defined in claim 1, wherein said first and second portions of said frame means are divided into subportions joined together by a further pair of hinges disposed along a line perpendicular to said axis of symmetry, said further pair of hinges pivoting about parallel axes extending substantially perpendicular to the plane of said framework when same is in its open configuration and permitting said framework when in its folded configuration to be collapsed on itself to form a generally rectangular package.

8. Apparatus as defined in claim 7, wherein said further pair of hinges includes lock means for assisting in retaining said framework in said open configuration.

9. Apparatus as defined in claim 7, wherein each of said further pair of hinges includes a clip affixed to a respective one of said framework subportions and provided with a further hole;

an element provided with a further bore and affixed to another of said subportions and pivotally attached to said clip, said clip and said element being pivotal relative to one another about one of said axes perpendicular to the plane of said framework when same is in said open configuration; and bolt means also extend into said further bore and said further hole for preventing said framework subportions from moving within the plane of said framework when same is in said open configuration.

10. Apparatus as defined in claim 9, wherein said clip is substantially U-shaped, and said element includes a shank formed by a pair of adjacent, co-extensive parts received within the U-shaped portion of said clip, said further bore being formed in said parts and arranged in register with said further hole.

* * * * *